United States Patent [19]

Hiraishi et al.

[11] Patent Number: 4,874,740

[45] Date of Patent: Oct. 17, 1989

[54] THERMOSENSITIVE RECORDING MATERIAL

[75] Inventors: Shigetoshi Hiraishi, Tokyo; Naomasa Koike, Takasago; Kazuyoshi Kondo; Mitsuru Fuchigami, both of Tokyo, all of Japan

[73] Assignee: Mitsubishi Paper Mills, Ltd., Tokyo, Japan

[21] Appl. No.: 151,461

[22] Filed: Feb. 2, 1988

Related U.S. Application Data

[62] Division of Ser. No. 822,590, Jan. 27, 1986, Pat. No. 4,742,042.

[30] Foreign Application Priority Data

| | | | |
|---|---|---|---|
| Jan. 31, 1985 | [JP] | Japan | 60-15385 |
| Mar. 4, 1985 | [JP] | Japan | 60-43192 |
| Mar. 4, 1985 | [JP] | Japan | 60-43193 |
| Mar. 4, 1985 | [JP] | Japan | 60-43194 |
| Mar. 4, 1985 | [JP] | Japan | 60-43195 |
| Apr. 2, 1985 | [JP] | Japan | 60-069691 |

[51] Int. Cl.[4] ..... B41M 5/18

[52] U.S. Cl. ..... 503/201; 427/150; 427/151; 428/913; 428/914; 503/208; 503/209; 503/216; 503/217; 503/220; 503/225

[58] Field of Search ..... 427/150–152; 503/208, 209, 216, 217, 220, 225, 226; 428/913, 914

[56] References Cited

U.S. PATENT DOCUMENTS

| | | | |
|---|---|---|---|
| 4,672,401 | 6/1987 | Yamada et al. | 503/209 |
| 4,764,500 | 8/1988 | Araki et al. | 503/209 |

*Primary Examiner*—Bruce H. Hess

*Attorney, Agent, or Firm*—Cushman, Darby & Cushman

[57] ABSTRACT

There is disclosed a thermosensitive recording material improved in thermal response and image retention which comprises a support and, provided thereon, a thermosensitive recording layer containing a generally colorless or slightly colored dye precursor and a developer which, upon being heated, reacts with said dye precursor to develop color, wherein said thermosensitive recording layer contains as sensitizer a compound selected from a group consisting of p-benzylbiphenyl, diaryl esters of adipic acid, (wherein R represents a substituted or unsubstituted aralkyl group, (wherein $R_1$ and $R_2$ each represents an alkyl, aralkyl, or aryl group), and and said developer is bis(3-allyl-4-hydroxyphenyl)sulfone.

14 Claims, No Drawings

THERMOSENSITIVE RECORDING MATERIAL

This is a division of application Ser. No. 822,590, filed Jan. 27, 1986 U.S. Patent 4,742,042.

BACKGROUND OF THE INVENTION

This invention relates to a thermosensitive recording material and, more particularly, to a thermosensitive recording material improved in thermal response and image retention.

Thermosensitive recording materials are generally composed of a support and, provided thereon, a thermosensitive recording layer containing as major constituents an ordinarily colorless or slightly colored dye precursor and an electron receptive developer. Upon being heated by means of a thermal head, thermal pen, or laser beam, the major constituents instantly reacts with each other to form a recorded image, as disclosed by Japanese Patent Examined Publication Nos. 4,160/68 and 14,039/70. Because of the advantages of comparatively simple design and easy maintainance, the recording devices employing such thermosensitive materials are being used in a wide field including recording instruments for measurements, facsimiles, printers, terminal devices for computers, labels, and automatic vending machines for railroad tickets and the like.

The fundamental performance characteristics required for the thermosensitive recording material include sufficient density of the color image, high sensitivity, and freedom from the deterioration in color image with time. Furthermore, the recent strive for the speed-up of impression recording demands the development of both the high speed recording device itself and the corresponding recording material which answers to the required speed. For this purpose, it is necessary to develop a recording material of a sufficient thermal response capable of producing a high-density color image at a low thermal energy. As the use of thermosensitive recording materials becomes popular, the fat resistance of the recording material is also required to keep the recorded image from deterioration due to the contact with oily substances such as fatty matters contained in hairdressing preparations, hand creams, or skin secretions. Thus, the advent of a thermosensitive recording material satisfactory in both the thermal response and the image retention is requested.

It has, heretofore, been known to incorporate various additives into the thermosensitive recording layer in order to produce a high-density color image, such as, for example, urea, phthalic anhydride, acetanilide, or the like, as disclosed in Japanese Patent Examined Publication No. 4,160/78; natural and synthetic waxes such as beeswax, carnauba wax, or paraffin wax, as disclosed in Japanese Patent Examined Publication No. 19,231/73; and salicylic acid, monobenzyl phthalate, or the like, as disclosed in Japanese Patent Examined Publication No. 17,748/74. Japanese Patent Unexamined Publication (Lain-open) No. 119,893/83 discloses the addition of bis(4-hydroxyphenyl)sulfone as developer to improve the image retention. These additives, however, are found to be unable to act satisfactorily, because of their undesirable effects on the characteristics of thermosensitive recording materials, such as insufficient thermal response to produce a satisfactory image density, or insufficient image retention, the image becoming deteriorated with time even though an image of sufficient density is produced.

SUMMARY OF THE INVENTION

An object of this invention is to provide a thermosensitive recording material excellent in thermal response and image retention.

DESCRIPTION OF THE INVENTION

According to this invention, there is obtained a thermosensitive recording material excellent in both the thermal response and the image retention which comprises a generally colorless or slightly colored dye precursor and a developer which, upon being heated, reacts with said dye precursor to develop color, wherein bis(3-allyl-4-hydroxyphenyl)sulfone is used as the developer and a compound selected from a group consisting of p-benzylbiphenyl, diaryl adipates,

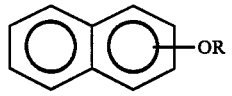

(wherein R represents a substituted or unsubstituted aralkyl group),

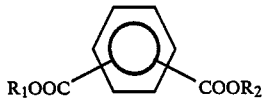

(wherein $R_1$ and $R_2$ each represents an alkyl, aralkyl, or aryl group), and

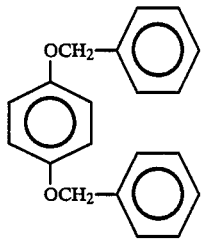

is added as a sensitizer. It was found that said developer improves the image retention but not the thermal response and that the thermal response can be improved by the addition of said heat sensitizer selected from a group of effective compounds found as a result of an extensive study.

According to this invention, the developer and the sensitizer are added each in an amount of 5% by weight or more, preferably 10 to 600, most preferably 20 to 500, % by weight based on the dye precursor. If the amount of either component is below 5% by weight, the heat response or the image retention is unsatisfactory, whereas if the amount exceeds 600% by weight, the thermal head tends to be covered with fusible scum which interferes with the impression. The heat sensitizer is used in an amount of generally 10 to 200, preferably 20 to 140, % by weight based on the developer. The heat response can be further improved by the addition of a fusible substance having a melting point of 80° to 160° C., such as stearic acid amide or N-hydroxymethylstearic acid amide.

The major components used in the present thermosensitive recording material are described hereunder with reference to nonlimitative examples of individual compounds.

As examples of diaryl adipates used as heat sensitizer, mention may be made of diphenyl adipate, bis(o-chlorophenyl) adipate, bis(p-chlorophenyl) adipate, and bis (p-methylphenyl) adipate.

As examples of compounds represented by the general formula

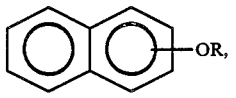

there may be mentioned 1-benzyloxynaphthalene, 2-benzyloxynaphthalene, 2-p-methylbenzyloxynaphthalene, and 2-p-chlorobenzyloxynaphthalene.

Examples of compounds represented by the general formula

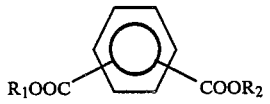

are diphenyl phthalate, dibenzyl isophthalate, dimethyl terephthalate, and dibenzyl terephthalate.

The dye precursors include compounds of the triphenylmethane, fluorane, diphenylmethane, thiazine, and spiropyrane classes. As examples, mention may be made of 3,3-bis(p-dimethylaminophenyl)-6-dimethylaminophthalide, 3(4-diethylamino-2-ethoxyphenyl)-3-(1-ethyl-2-methylindol-3-yl)-4-azaphthalide, 3-dimethylamino-6-methyl-7-chlorofluorane, 3-diethylamino-7-chlorofluorane, 3-(N-cyclohexylamino)-7-methylfluorane, 3-diethylamino-7-methylfluorane, 3-diethylamino-6-chloro-7-methylfluorane, 3-diethylamino-7-anilinofluorane, 3-diethylamino-6-methyl-7-dibenzyl-aminofluorane, 3-(N-ethyl-N-p-toluidino)-7-anilinofluorane, 3-diethylamino-7-(o-chloroanilino)fluorane, 3-dibutylamino-7-(o-chloroanilino)fluorane, 3-diethylamino-6-methyl-7-anilinofluorane, 3-(N-ethyl-N-p-toluidino)-6-methyl-7-anilinofluorane, 3-(N-methyl-N-cyclohexylamino)-6-methyl-7-anilinofluorane, 3-piperidino-6-methyl-7-anilinofluorane, 3-pyrrolidino-6-methyl-7-anilinofluorane, 3-diethylamino-7-(m-trifluoromethylamino)fluorane, 3-(N-ethyl-N-isopentylamino)-6-methyl-7-anilinofluorane, 3-diethylamino-6-methyl-7-(p-phenetidino)-fluorane, 3-dibutylamino-7-(o-fluoroanilino)fluorane, 3-diethylamino-6-methyl-7-(dimethylanilino)fluorane, etc.

Further, fluorene compounds represented by the general formula

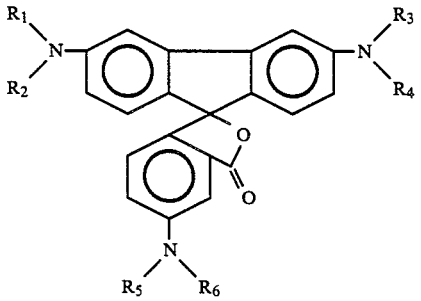

(wherein $R_1$, $R_2$, $R_3$, $R_4$, $R_5$ and $R_6$ represent each a lower alkyl group) can also be used with desirable results. The fluorene compounds of the above general formula are colorless or slightly colored crystals which show no absorption in the near infrared region but when reacted with a developer they produce a color in the region of from blue to green and the color image shows an absorption in the near infrared region.

As examples of the above fluorene compounds, mention may be made of 3,6-bis(dimethylamino)fluorene-9-spiro-3'-(6-dimethylaminophthalide), 3-diethylamino-6-dimethylaminofluorene-9-spiro-3'-(6'-dimethylaminophthalide), 3,6-bis(diethylamino)fluorene-9-spiro-3'-(6'-dimethylaminophthalide), 3-dibutylamino-6-dimethylaminofluorene-9-spiro-3'-(6'-dimethylaminophthalide), 3-dibutylamino-6-diethylaminofluorene-9-spiro-3'-(6'-dimethylaminophthalide), 3,6-bis(dimethylamino)fluorene-9-spiro-3'-(6'-diethylaminophthalide), 3-diethylamino-6-dimethylaminofluorene-9-spiro-3'-(6'-diethylaminophthalide), 3-dibutylamino-6-dimethylaminofluorene-9-spiro-3'-(6'-diethylaminophthalide), 3,6-bis(diethylamino)fluorene-9-spiro-3'-(6'-diethylaminophthalide), 3,6-bis(dimethylamino)fluorene-9-spiro-3'-(6'-dibutylaminophthalide), 3-dibutylamino-6-diethylaminofluorene-9-spiro-3'-(6'-diethylaminophthalide), and 3-diethylamino-6-dimethylaminofluorene-spiro-3'-(6'-dibutylaminophthalide).

When the above fluorene compounds are used, there is obtained an image in a color ranging from blue to green. In order to adjust the tone, it is possible to use auxiliarily a leuco dye which produces a red or black image, so long as the objects of this invention are not interfered with. As examples of such leuco dyes, there may be mentioned 2-anilino-3-methyl-6-N-methyl-N-cyclohexylaminofluorane, 2-anilino-3-methyl-6-diethylaminofluorane, 2-anilino-3-methyl-6-N-ethyl-N-isoamylaminofluorane, 2-(2'-chloroanilino)-6-diethylaminofluorane, 2-(2'-chloroanilino)-6-dibutylaminofluorane, 2-anilino-3-methyl-6-N-ethyl-N-p-tolylaminofluorane, 2-anilino-3-methyl-6-pyrrolidinofluorane, 2-p-phenetidino-3-methyl-6-diethylaminofluorane, 2-m-trifluoromethylanilino-6-diethylaminofluorane, 2-chloro-3-methyl-6-diethylaminofluorane, 2-chloro-6-diethylaminofluorane, and 3,3-bis(1-octyl-2-methylindol-3-yl)phthalide.

As examples of binders, mention may be made of water-soluble binders such as starches, hydroxyethylcellulose, methylcellulose, carboxymethylcellulose, gelatin, casein, polyvinyl alcohol, modified polyvinyl alcohol, styrene-maleic anhydride copolymers, and ethylene-maleic anhydride copolymers; and latex-type water-insoluble binders such as styrene-butadiene copolymers, acrylonitrile-butadiene copolymers, and methyl acrylate-butadiene copolymers.

As pigments, mention may be made of diatomaceous earth, talc, kaolin, calcined kaolin, calcium carbonate, magnesium carbonate, titanium oxide, zinc oxide, silicon oxide, aluminum hydroxide, and urea-formaldehyde resins.

Other additives include anti-head abrasion or anti-sticking agents such as zinc stearate, calcium stearate, other metal salts of higher fatty acids, paraffin, oxidized paraffin, polyethylene, oxidized polyethylene, stearamide, castor wax, and other waxes; dispersants such as sodium dioctylsulfosuccinate; UV absorbers such as those of the benzophenone type and the benzotriazole type; surfactants and fluorescent dyes.

The supports used in the thermosensitive recording material of this invention include paper, which is mainly used, various nonwoven fabrics, plastic films, synthetic paper, metal foils, and composites of these materials.

The thermosensitive recording material of this invention can be used in thermosensitive recording labels. A thermosensitive color-forming layer is provided on a support and overlaid with a protective layer to protect the recorded color image areas and the remaining uncolored areas from external environment. The protective layer contains as major component various water-soluble resins, latices, or light-setting resins. If necessary, pigments, water-proofing agents, water repellants, defoamers, and UV absorbers can be added. The back side of the support is provided with an adhesive layer to adhere to another solid surface. The adhesive layer is covered with a release paper sheet. The thermosensitive recording label is used as bar code label in the POS (point of sales) system, price label, and delivery label, all of which are required to adhere to various articles after impression. The bar code, etc. which are impressed on labels and the like, have conventionally been read out by means of He-Ne laser beam of 633 nm (red) in wavelength, and the abovestated fluorane compounds which form black color have mainly been used as the dye precursor. However, recently semiconductor laser beam having wavelength in the near infrared region of from 700 to 1,500 nm is used and when fluorane compounds are used, the impressed bar code, etc. cannot be read out by means of semiconductor laser beam because absorption wavelength of color image is only in visible light region. For this reason, the above-mentioned fluorene compounds which afford color images having absorption wavelength in the near infrared region are used, but color images formed with the fluorene compounds are generally poor in shelf stability and they cannot be actually used. However, it has become possible by using the thermosensitive recording materials of this invention to actually use them with no problems.

The invention is described in detail in the following with reference to Examples.

EXAMPLE 1

A dispersion was prepared by milling 10 g of 3-diethylamino-6-methyl-7-anilinofluorane together with 30 g of a 2-% aqueous solution of polyvinyl alcohol in a ball mill for 24 hours. Another dispersion was prepared by milling together 25 g of bis(3-allyl-4-hydroxyphenyl)sulfone and 75 g of a 2-% aqueous polyvinyl alcohol solution in a ball mill for 24 hours. A still another dispersion was prepared by milling together 25 g of p-benzylbiphenyl and 75 g of a 2-% aqueous polyvinyl alcohol solution in a ball mill for 24 hours. These three dispersions were mixed together and added with 80 g of a 50-% dispersion of calcium carbonate followed by 25 g of a 20-% dispersion of zinc stearate and 200 g of a 10-% aqueous polyvinyl alcohol solution. The mixture was thoroughly stirred to obtain a coating composition.

The coating composition was coated on a base paper sheet, 55 g/m$^2$ in basis weight, at a coverage of 4.0 g/m$^2$ on dry basis, then dried, and treated by a super calender to obtain a thermosensitive recording material.

COMPARATIVE EXAMPLE 1

A thermosensitive recording material was prepared by repeating the procedure of Example 1, except that 2,2-bis(4-hydroxyphenyl)propane and stearamide were used in place of the bis(3-allyl-4-hydroxyphenyl)sulfone and p-benzylbiphenyl, respectively.

COMPARATIVE EXAMPLE 2

A thermosensitive recording material was prepared by repeating the procedure of Example 1, except that bis(4-hydroxyphenyl)sulfone and stearamide were used in place of the bis(3-allyl-4-hydroxyphenyl)sulfone and p-benzylbiphenyl, respectively.

The recording test on the thermosensitive recording materials obtained above was performed by means of a thermosensive paper testing apparatus of Matsushita Electronic Components Co. and the developed color density was measured by means of Macbeth densitometer. The resistances to plasticizer and water with respect to the recorded areas were also tested. The results obtained were as shown in Table 1.

TABLE 1

| | Developed color density | Resistance to plasticizer | Resistance to water |
|---|---|---|---|
| Example 1 | 1.16 | 1.14 | 1.13 |
| Comparative Example 1 | 1.12 | 0.72 | 0.62 |
| Comparative Example 2 | 0.90 | 0.85 | 0.83 |

Note

Test for the resistance to plasticizer

After impression, the test specimen was covered on the surface with food-grade wrapping film and left standing at room temperature. After one week, the density of developed color areas was tested by Macbeth densitometer.

Test for the resistance to water

After impression, the test specimen was dipped in water at 20° C. for 24 hours and the density of developed color areas was tested by Macbeth densitometer.

EXAMPLE 2

A dispersion was prepared by milling together 10 g of 3-diethylamino-6-methyl-7-anilinofluorane and 30 g of a 2-% aqueous polyvinyl alcohol solution in a ball mill for 24 hours. Another dispersion was prepared by milling together 25 g of bis(3-allyl-4-hydroxyphenyl)sulfone and 75 g of a 2-% aqueous polyvinyl alcohol solution in a ball mill for 24 hours. A still another dispersion was prepared by milling together 25 g of diphenyl adipate and 75 g of a 2-% aqueous polyvinyl alcohol solution in a ball mill for 24 hours. The three dispersions were mixed and added with 80 g of a 50-% dispersion of calcium carbonate followed by 25 g of a 20-% dispersion of zinc stearate and 200 g of a 10-% aqueous polyvinyl alcohol solution. The mixture was thoroughly stirred to obtain a coating composition.

The coating composition was coated on a base paper sheet, 55 g/m$^2$ in basis weight, at a coverage of 4.0 g/m$^2$ on dry basis, then dried, and treated by a super calender to obtain a thermosensitive recording material.

COMPARATIVE EXAMPLE 3

A thermosensitive recording material was prepared by repeating the procedure of Example 2, except that 2,2-bis(4-hydroxyphenyl)propane and stearamide were used in place of the bis(3-allyl-4-hydroxyphenyl)sulfone and diphenyl adipate, respectively.

COMPARATIVE EXAMPLE 4

A thermosensitive recording material was prepared in the same manner as in Example 2, except that bis(4-hydroxyphenyl)sulfone and stearamide were used in place of the bis(3-allyl-hydroxyphenyl)sulfone and diphenyl adipate, respectively.

The recording test on the thermosensitive recording materials obtained above was performed by means of a thermosensitive paper testing apparatus of Matsushita Electronic Components Co. and the developed color density was measured by means of Macbeth densitometer. The resistances to plasticizer and water were also tested on the recorded areas. The results obtained were as shown in Table 2.

TABLE 2

| | Developed color density | Resistance to plasticizer | Resistance to water |
|---|---|---|---|
| Example 2 | 1.22 | 1.20 | 1.21 |
| Comparative Example 3 | 1.12 | 0.72 | 0.62 |
| Comparative Example 4 | 0.90 | 0.85 | 0.83 |

Note

Test for the resistance to plasticizer

After impression, the test specimen was covered on the surface with food-grade wrapping film and left standing at room temperature. After one week, the density of developed color areas was tested by Macbeth densitometer.

Test for the resistance to water

After impression, the test specimen was dipped in water at 20° C. for 24 hours and the density of developed color areas was tested by Macbeth densitometer.

EXAMPLE 3

A dispersion was prepared by milling together 10 g of 3-diethylamino-6-methyl-7-anilinofluorane and 30 g of a 2-% aqueous polyvinyl alcohol solution in a ball mill for 24 hours. Another dispersion was prepared by milling together 25 g of bis(3-allyl-4-hydroxyphenyl)sulfone and 75 g of a 2-% aqueous polyvinyl alcohol solution in a ball mill for 24 hours. A still another dispersion was prepared by milling together 25 g of 2-benzyloxynaphthalene and 75 g of a 2-% aqueous polyvinyl alcohol solution in a ball mill for 24 hours. The three dispersions were mixed and added with 80 g of a 50-% dispersion of calcium carbonate, followed by 25 g of a 20-% dispersion of zinc stearate and 200 g of a 10-% aqueous polyvinyl alcohol solution. The mixture was thoroughly stirred to obtain a coating composition.

The coating composition was coated on a base paper sheet, 55 g/m$^2$ in basis weight, at a coverage of 4.0 g/m$^2$ on dry basis, then dried, and treated by a super calender to obtain a thermosensitive recording material.

COMPARATIVE EXAMPLE 5

A thermosensitive recording material was prepared in the same manner as in Example 3, except that 2,2-bis(4-hydroxyphenyl)propane and stearamide were used in place of the bis(3-allyl-4-hydroxyphenyl)sulfone and 2-benzyloxynaphthalene, respectively.

COMPARATIVE EXAMPLE 6

A thermosensitive recording material was prepared in the same manner as in Example 3, except that bis(4-hydroxyphenyl)sulfone and stearamide were used in place of the bis(3-allyl-4-hydroxyphenyl)sulfone and 2-benzyloxynaphthalene, respectively.

The recording test on the thermosensitive recording materials obtained above was performed by means of a thermosensitive paper testing apparatus of Matsushita Electronic Components Co. and the developed color density was measured by Macbeth densitometer. The resistances to plasticizer and water were also tested on the recorded areas. The results obtained were as shown in Table 3.

TABLE 3

| | Developed color density | Resistance to plasticizer | Resistance to water |
|---|---|---|---|
| Example 3 | 1.21 | 1.21 | 1.19 |
| Comparative Example 5 | 1.12 | 0.72 | 0.62 |
| Comparative Example 6 | 0.90 | 0.85 | 0.83 |

EXAMPLE 4

A dispersion was prepared by milling together 10 g of 3-diethylamino-6-methyl-7-anilinofluorane and 30 g of a 2-% aqueous polyvinyl alcohol solution in a ball mill for 24 hours. Another dispersion was prepared by milling together 25 g of bis(3-allyl-4-hydroxyphenyl)sulfone and 75 g of a 2-% aqueous polyvinyl alcohol solution in a ball mill for 24 hours. A still another dispersion was prepared by milling together 25 g of dibenzyl terephthalate and 75 g of a 2-% aqueous polyvinyl alcohol solution in a ball mill for 24 hours. The three dispersions were mixed and added with 80 g of a 50-% dispersion of calcium carbonate followed by 25 g of a 20-% dispersion of zinc stearate and 200 g of a 10-% aqueous polyvinyl alcohol solution. The mixture was thoroughly stirred to obtain a coating composition.

The coating composition was coated on a base paper sheet, 55 g/m$^2$ in basis weight, at a coverage of 4.0 g/m$^2$ on dry basis, then dried, and treated by a super calender to obtain a thermosensitive recording material.

EXAMPLE 5

A thermosensitive recording paper sheet was prepared in the same manner as in Example 4, except that dibenzyl isophthalate was used in place of the dibenzyl terephthalate.

COMPARATIVE EXAMPLE 7

A thermosensitive recording material was prepared in the same manner as in Example 4, except that 2,2-bis(4-hydroxyphenyl)propane and stearamide were used in place of the bis(3-allyl-4-hydroxyphenyl)sulfone and dibenzyl terephthalate, respectively.

COMPARATIVE EXAMPLE 8

A theromsensitive recording material was prepared in the same manner as in Example 4, except that bis(4-hydroxyphenyl)sulfone and stearamide were used in place of the bis(3-allyl-4-hydroxyphenyl)sulfone and dibenzyl terephthalate, respectively.

The recording test on the thermosensitive recording materials obtained above was performed by means of a thermosensitive paper testing apparatus of Matsushita Electronic Components Co. and the developed color density was measured by Macbeth densitometer. The resistances to plasticizer and water were also tested on the recorded areas. The results obtained were as shown in Table 4.

TABLE 4

| | Developed color density | Resistance to plasticizer | Resistance to water |
|---|---|---|---|
| Example 4 | 1.22 | 1.20 | 1.19 |
| Example 5 | 1.19 | 1.19 | 1.17 |
| Comparative Example 7 | 1.12 | 0.72 | 0.62 |
| Comparative Example 8 | 0.90 | 0.85 | 0.83 |

EXAMPLE 6

A dispersion was prepared by milling together 20 g of 3,6-bis(dimethylamino)fluorene-9-spiro-3'-(6'-dimethylaminophthalide) and 80 g of a 1-% aqueous polyvinyl alcohol solution in a ball mill. Another dispersion was prepared by milling together 50 g of bis(3-allyl-4-hydroxyphenyl)sulfone and 200 g of a 1-% aqueous polyvinyl alcohol solution in a ball mill. To the mixture of both dispersions, were added 250 g of a 40-% dispersion of calcium carbonate, 40 g of a 25-% dispersion of zinc stearate, 200 g of a 25-% disperison of 2-benzyloxynaphthalene, and 625 g of a 8-% aqueous polyvinyl alcohol solution. The resulting mixture was thoroughly stirred to obtain a coating composition.

The coating composition was coated on a base paper sheet, 55 g/m$^2$ in basis weight, at a coverage of 6 g/m$^2$ on dry basis, then dried to form a thermosensitive color-forming layer. An overcoating composition was prepared by uniformly mixing 50 g of calcium carbonate, 500 g of a 10-% aqueous polyvinyl alcohol solution, and 5 g of a hardener. The overcoating composition was coated on the thermosensitive color-forming layer at a coverage of 5 g/m$^2$ on dry basis and dried to provide a protective layer. The resulting coated paper sheet was provided, on the back side, with an adhesive layer which was covered with a release paper sheet to prepare a thermosensitive recording lable.

EXAMPLE 7

A thermosensitive recording label was prepared in the same manner as in Example 6, except that 2-anilino-3-methyl-6-diethylaminofluorane was used in place of the 3,6-bis(dimethylamino)fluorene-9-spiro-3'-(6'-dimethylaminophthalide).

EVALUATION

The thermosensitive recording labels obtained in Example 6 and Example 7 were evaluated for the following items. The results obtained were as shown in Table 5.

1. Developed color density

The recording test on the thermosensitive recording labels obtained above was performed by means of a thermosensitive paper testing apparatus of Matsushita Electronic Components Co. and the developed color density was measured by means of Macbeth densitometer RD 918 using a filter for 624 nm.

2. Reading-out with near infrared rays

The reading-out of bar codes was tested using a GaAs semiconductor laser beam (780 nm).

TABLE 5

| | Developed color density | Reading-out |
|---|---|---|
| Example 6 | 1.12 | Possible |
| Example 7 | 1.00 | Impossible |

(It was of course possible for both labels to read-out with visible light.)

EXAMPLE 8

A thermosensitive recording material was prepared in the same manner as in Example 6, except that a mixture of bis(3-allyl-4-hydroxyphenyl)sulfone and 3-allyl-4,4'-dihydroxydiphenylsulfone was used in place of the bis(3-allyl-4-hydroxyphenyl)sulfone.

COMPARATIVE EXAMPLE 9

A thermosensitive recording material was prepared in the same manner as in Example 8, except that 4,4'-isopropylidenediphenol was used in place of the mixture of bis(3-allyl-4-hydroxyphenyl)sulfone and 3-allyl-4,4'-dihydroxydiphenyl sulfone.

EVALUATION

The thermosensitive recording materials prepared in Example 8 and Comparative Example 9 were tested for the following items:

1. Developed color density

The recording test on the thermosensitive recording materials obtained above was performed by means of a thermosensitive paper testing apparatus of Matsushita Electronic Components Co. and the developed color density was measured by means of Macbeth densitometer RD 918.

2. Image retention

The specimen bearing a developed color image was stored under an atmosphere at 60° C. for 24 hours. The image retention (%) was calculated from the optical densities before and after the storage, using the following equation:

$$\text{Image retention (\%)} = \frac{\text{Optical density after storage}}{\text{Optical density before storage}} \times 100$$

3. Resistance of image to water

The specimen bearing a developed color image was dipped in 2 liters of tap water at 20° C. for 20 hours. The image retention was calculated as described above.

4. Reading-out with near infrared rays

The reading-out of bar code was tested using a GaAs semiconductor laser beam (780 nm).

The results of evaluation were as shown in Table 6.

TABLE 6

| | Evaluation 1. Developed Color density | Evaluation 2. Image Retention (%) | Evaluation 3.Resistance of image to water (%) | Evaluation 4. Reading-out |
|---|---|---|---|---|
| Example 8 | 0.90 | 75 | 76 | Possible |
| Comparative Example 9 | 0.74 | 64 | 34 | Possible |

EXAMPLE 9

A thermosensitive recording material was prepared in the same manner as in Example 1, except that

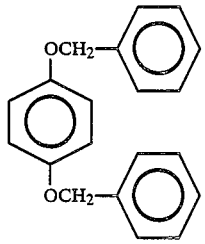

was used in place of the p-benzylbiphenyl. The results of test were similar to those obtained in Example 1.

What is claimed is:

1. A thermosensitive recording material comprising a support and, provided thereon, a thermosensitive recording layer containing a generally colorless or slightly colored dye precursor and a developer which, upon being heated, reacts with said dye precursor to develop color, wherein said thermosensitive recording layer contains as sensitizer a compound selected from a group consisting of p-benzylbiphenyl, diaryl esters of adipic acid,

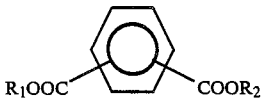

(wherein $R_1$ and $R_2$ each represents an alkyl, aralkyl, or aryl group), and

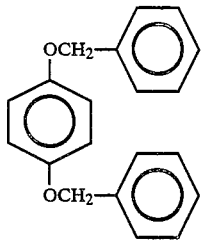

and said developer is bis(3-allyl-4-hydroxyphenyl(sulfone or combination of bis(3-allyl-4-hydroxyphenyl)sulfone and 3-allyl-4,4'-dihydroxydiphenylsulfone.

2. A thermosensitive recording material according to claim 1, wherein the sensitizer is diphenyl adipate, bis(o-chlorophenyl) adipate, bis(p-chlorophenyl) adipate, or bis(p-methylphenyl) adipate.

3. A thermosensitive recording material according to claim 1, wherein the sensitizer is a compound represented by the formula

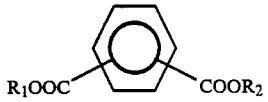

and is diphenyl phthalate, dibenzyl isophthalate, dimethyl terephthalate, or dibenzyl terephthalate.

4. A thermosensitive recording material according to claim 1 wherein the sensitizer is p-benzylbiphenyl.

5. The thermosensitive recording material according to claim 1, wherein the dye precursor is 3-diethylamino-6-methyl-7-anilinofluorane.

6. The thermosensitive recording material according to claim 1, wherein the dye precursor is a fluorene compound represented by the general formula

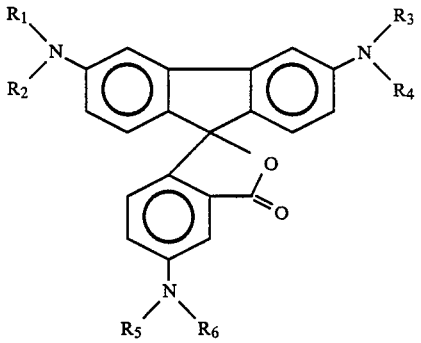

(I)

wherein $R_1$, $R_2$, $R_3$ $R_4$, $R_5$ and $R_6$ represent each a lower alkyl group.

7. The thermosensitive recording material according to claim 6, wherein the dye precursor is 3,6-bis(dimethylamino)fluorene-9-spiro-3'-(6'dimethylaminophthalide).

8. The thermosensitive recording material according to claim 1, wherein the proportion of the sensitizer to the developer is in the range of from 10 to 200% by weight.

9. The thermosensitive recording material according to claim 8, wherein the proportion of the sensitizer to the developer is in the range of from 20 to 140% by weight.

10. The thermosensitive recording material according to claim 1, wherein the proportion of the sensitizer to the dye is in the range of from 20 to 500% by weight.

11. The thermosensitive recording material according to claim 1, wherein a protective layer is provided over the thermosensitive recording layer.

12. A thermosensitive recording label comprising the thermosensitive recording material according to claim 11 and an adhesive layer provided on the back side of the support.

13. The thermosensitive recording material according to claim 11, wherein the dye precursor is a fluorene compound represented by the general formula:

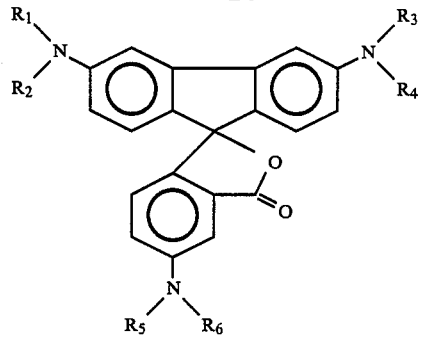
(I)
wherein $R_1$, $R_2$, $R_3$ $R_4$, $R_5$ and $R_6$ represent each a lower alkyl group.
14. A method of thermosensitive recording which comprises heating the thermosensitive recording material according to claim 1.
* * * * *